US007594499B2

(12) United States Patent
Suzuki et al.

(10) Patent No.: US 7,594,499 B2
(45) Date of Patent: Sep. 29, 2009

(54) FUEL FEED APPARATUS AND ACCUMULATOR FUEL INJECTION SYSTEM HAVING THE SAME

(75) Inventors: Masashi Suzuki, Obu (JP); Hiroyuki Shimai, Kariya (JP); Mitsuru Nagai, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/952,827

(22) Filed: Dec. 7, 2007

(65) Prior Publication Data

US 2008/0156295 A1 Jul. 3, 2008

(30) Foreign Application Priority Data

Dec. 27, 2006 (JP) ..... 2006-352241
May 25, 2007 (JP) ..... 2007-138716

(51) Int. Cl.
*F02M 57/02* (2006.01)
*F02M 37/00* (2006.01)

(52) U.S. Cl. ..... 123/446; 123/510; 123/514

(58) Field of Classification Search ..... 123/446, 123/447, 514, 510, 511
See application file for complete search history.

(56) References Cited

U.S. PATENT DOCUMENTS 5,636,616 A * 6/1997 Okane et al. ..... 123/514
5,884,606 A * 3/1999 Kellner et al. ..... 123/446
6,021,761 A * 2/2000 Kellner et al. ..... 123/495
6,142,747 A * 11/2000 Rosenau et al. ..... 417/251
6,253,740 B1 * 7/2001 Rembold ..... 123/509
6,289,875 B1 9/2001 Shinohara et al.
6,520,162 B1 * 2/2003 Schueler ..... 123/510
6,772,734 B2 * 8/2004 Schueler ..... 123/446
6,895,936 B2 * 5/2005 Kuroda ..... 123/446
6,976,473 B2 * 12/2005 Boos et al. ..... 123/446
7,077,107 B2 * 7/2006 Boos et al. ..... 123/446
7,314,351 B2 * 1/2008 Kuroda ..... 417/251
7,377,753 B2 * 5/2008 Kuroda ..... 417/251
2004/0208753 A1 * 10/2004 Mori ..... 417/244
2006/0169251 A1 8/2006 Mori et al.

FOREIGN PATENT DOCUMENTS

JP 2000-240531 9/2000
JP 2006-207499 8/2006

OTHER PUBLICATIONS

U.S. Appl. No. 12/015,053, filed Jan. 2008, Shimai.

* cited by examiner

*Primary Examiner*—Thomas N Moulis
(74) *Attorney, Agent, or Firm*—Nixon & Vanderhye, PC

(57) ABSTRACT

A fuel feed apparatus is provided for supplying high-pressure fuel to a common rail of an accumulator fuel injection system. The accumulator fuel injection system includes an injector for injecting high-pressure fuel accumulated in the common rail into a combustion chamber of an internal combustion engine. The fuel feed apparatus includes a high-pressure pump for press-feeding fuel to the common rail, and a feed pump for pumping fuel from a fuel tank to the high-pressure pump. A fuel filter is provided downstream of the feed pump for filtering fuel pumped from the feed pump. A return passage is provided for returning fuel from a downstream of the feed pump to an upstream of the feed pump. A return flow control unit is provided for controlling fuel retuning through the return passage.

11 Claims, 8 Drawing Sheets

FUEL FEED APPARATUS AND ACCUMULATOR FUEL INJECTION SYSTEM HAVING THE SAME

CROSS REFERENCE TO RELATED APPLICATIONS

This application is based on and incorporates herein by reference Japanese Patent Applications No. 2006-352241 filed on Dec. 27, 2006 and No. 2007-138716 filed on May 25, 2007.

FIELD OF THE INVENTION

The present invention relates to a fuel feed apparatus for an internal combustion engine. The present invention further relates to an accumulator fuel injection system having the fuel feed apparatus.

BACKGROUND OF THE INVENTION

Conventionally, US 20060169251 (JP-A-2006-207499) discloses a fuel feed apparatus provided to an accumulator fuel injection system of a diesel engine. The fuel feed apparatus includes a feed pump and a high-pressure pump. The feed pump supplies fuel from a fuel tank to the high-pressure pump. The high-pressure pump press-feeds high-pressure fuel to a common rail, which is provided for accumulating the high-pressure fuel in the accumulator fuel injection system.

The fuel feed apparatus in the US 20060169251 further includes a fuel filter and a relief valve. The fuel filter is provided downstream of the feed pump for filtering fuel. The relief valve releases fuel, which applies pressure to the fuel filter, toward the fuel tank when the pressure becomes equal to or greater than predetermined pressure.

In this structure, the fuel filter can be restricted from being plugged by applying pressure of the feed pump to the fuel filter, thereby sufficiently supplying fuel to the common rail, even when viscosity of fuel increases in, for example, a low temperature condition. In addition, the relief valve restricts the fuel filter from being applied with excessive pressure.

In the fuel feed apparatus disclosed in the US 20060169251, the feed pump press-feeds fuel, and the fuel returns to the fuel rank when the relief valve opens. In this structure, inlet flow of the feed pump needs to be increased, at least when the relief valve opens, to properly supply fuel to the high-pressure pump.

However, when the inlet flow of the feed pump is increased, pressure loss caused between the fuel pump and the feed pump becomes large, and consequently, suction load of the feed pump increases. Such increase in suction load may cause abnormal ablation in components of the feed pump, and may shorten a lifetime of the feed pump.

It is conceivable to increase the diameter of the inlet pipe between the fuel tank and the feed pump to decrease the pressure loss. However increase in the diameter of the inlet pipe enlarges the fuel feed apparatus.

SUMMARY OF THE INVENTION

In view of the foregoing and other problems, it is an object of the present invention to produce a fuel feed apparatus capable of reducing pressure loss in a feed pump without being excessively enlarged in size.

According to one aspect of the present invention, a fuel feed apparatus for supplying high-pressure fuel to a common rail of an accumulator fuel injection system, the accumulator fuel injection system including an injector for injecting high-pressure fuel accumulated in the common rail into a combustion chamber of an internal combustion engine, the fuel feed apparatus comprises a high-pressure pump for pressurizing fuel and press-feeding the fuel to the common rail. The fuel feed apparatus further comprises a feed pump for pumping fuel from a fuel tank to the high-pressure pump. The fuel feed apparatus further comprises a fuel filter provided downstream of the feed pump for filtering fuel pumped from the feed pump. The fuel feed apparatus further comprises a return passage for returning fuel from a downstream of the feed pump to an upstream of the feed pump. The fuel feed apparatus further comprises a return flow control unit for controlling flow of fuel retuning through the return passage.

According to another aspect of the present invention an accumulator fuel injection system for injecting high-pressure fuel into a combustion chamber of an internal combustion engine, the accumulator fuel injection system comprises a common rail for accumulating high-pressure fuel. The accumulator fuel injection system further comprises an injector for injecting high-pressure from the common rail into the combustion chamber. The accumulator fuel injection system further comprises a fuel feed apparatus for supplying high-pressure fuel to the common rail. The fuel feed apparatus comprises a high-pressure pump for pressurizing fuel and press-feeding the fuel to the common rail. The fuel feed apparatus further comprises a feed pump for pumping fuel from a fuel tank to the high-pressure pump. The fuel feed apparatus further comprises a fuel filter provided downstream the feed pump for filtering fuel pumped from the feed pump. The fuel feed apparatus further comprises a return passage for returning fuel from a downstream of the feed pump to an upstream of the feed pump. The fuel feed apparatus further comprises a return flow control unit for controlling flow of fuel retuning through the return passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
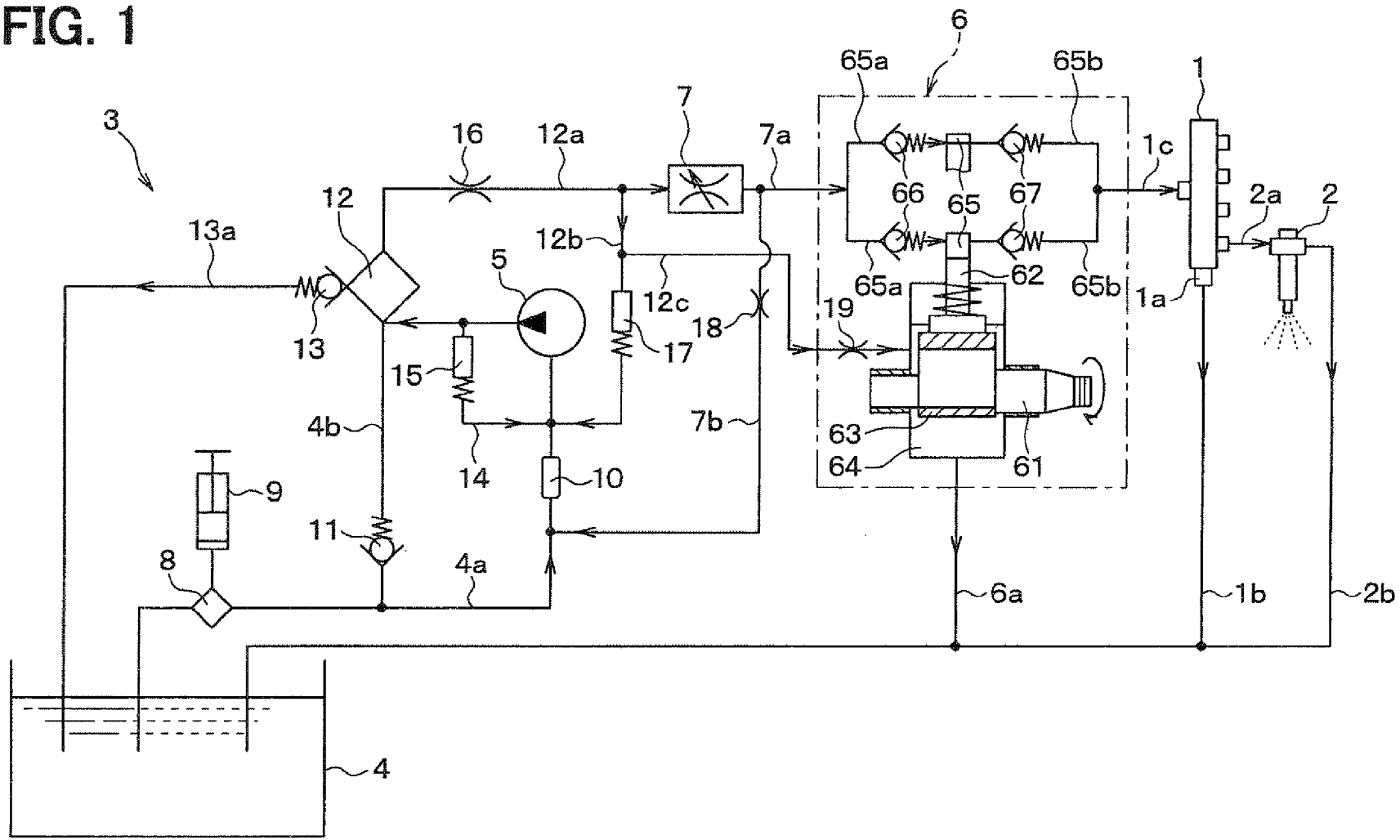
FIG. 1 is a schematic view showing an accumulator fuel injection system according to a first embodiment.

The first embodiment will be described with reference to FIG. 1.

An accumulator fuel injection system is applied to, for example, a four-cylinder diesel engine. The accumulator fuel injection system includes a common rail 1 for accumulating high-pressure fuel, injectors 2 for injecting the high-pressure fuel from a common rail 1 respectively into combustion chambers of the diesel engine, and a fuel feed apparatus 3 for feeding high-pressure fuel into the common rail 1.

The common rail 1 serves as an accumulating unit for accumulating high-pressure fuel supplied from the fuel feed apparatus 3 and holding the high-pressure fuel at target rail pressure. An unillustrated control unit (ECU) determines the target rail pressure in accordance with an operating condition such as a throttle position of an accelerator and rotation speed of the diesel engine.

The common rail 1 is provided with a pressure limiter 1*a* that opens for releasing fuel from the common rail 1 when pressure of fuel in the common rail 1 becomes greater than predetermined upper limit pressure. The fuel flowing from the pressure limiter 1*a* returns into a fuel tank 4 of the fuel feed apparatus 3 through a fuel pipe 1*b*.

Each injector 2 serves as a fuel injection unit for injecting high-pressure fuel into each combustion chamber of the diesel engine. The injector 2 is supplied with high-pressure fuel from the common rail 1 through a high-pressure pipe 2*a*. The high-pressure fuel supplied from the common rail 1 is partially not injected, and is returned as surplus fuel into the fuel tank 4 through a fuel pipe 2*b*. The ECU is connected with the injector 2 for controlling injection timing and injection amount of fuel by transmitting a control signal.

The fuel feed apparatus 3 includes the fuel tank 4 for accumulating fuel, a feed pump 5 for pumping the fuel from the fuel tank 4, a high-pressure pump 6 for pressurizing the fuel supplied from the feed pump 5 to press-feed the fuel to the common rail 1, and an inlet control valve 7 for controlling flow of the fuel supplied from the feed pump 5 to the high-pressure pump 6.

The feed pump 5 pumps fuel from the fuel tank 4 to the high-pressure pump 6 through an inlet pipe 4*a*. In this embodiment, the feed pump 5 is a trochoid pump being an internal gear pump. The feed pump 5 is connected with a camshaft 61 of the high-pressure pump 6, thereby being transmitted driving force via the camshaft 61.

The inlet pipe 4*a* is provided with a pre-filter 8 for removing foreign matters from fuel drawn from the fuel tank 4, and a priming pump 9 for venting gas from the inlet pipe 4*a* in, for example, an assembly work of the vehicle. Furthermore, a gauze filter 10 is provided to the inlet pipe 4*a* in the vicinity of an inlet port of the feed pump 5 for removing foreign matters contained in fuel through the inlet pipe 4*a* downstream of the pre-filer 8. The pre-filter 8 and/or the gauze filter 10 may be a metallic filter such as a metallic mesh.

A bypass passage 4*b* is connected to a passage between the downstream of the pre-filter 8 and the upstream of the gauze filter 10 in the inlet pipe 4*a*. The priming pump 9 is capable of pumping fuel to the downstream of the feed pump 5 also through the bypass passage 4*b*. The bypass passage 4*b* is provided with a check valve 11 for restricting fuel from flowing backward.

A fuel filter 12 is provided to the downstream of the feed pump 5 for filtering fuel discharged from the feed pump 5. A relief valve 13 is further provided to the downstream of the feed pump 5 for releasing fuel when pressure of the fuel applied to the fuel filter 12 becomes equal to or greater than predetermined pressure. The relief valve 13 opens, thereby partially returns fuel from the feed pump 5 to the fuel tank 4 through a fuel pipe 13*a*.

In this embodiment, the predetermined pressure, at which the relief valve 13 opens, is equal to or less than allowable pressure of the fuel filter 12, and is greater than discharge pressure of the feed pump 5 in an idling operation of the diesel engine. In this structure, the relief valve 13 is capable of protecting the fuel filter 12 from excessive fuel pressure applied from the feed pump 5.

In addition, the fuel filter can be applied with pressure of fuel discharged from the feed pump 5. Therefore, the fuel filter 12 may have a filtering mesh less than those of the pre-filter 8 and the gauze filter 10, so that the fuel filter 12 may have a filtering performance higher than those of the pre-filter 8 and the gauze filter 10. Thus, the fuel filter 12 is capable of removing particulate foreign matters, moisture, and the like, which cannot be removed using the pre-filter 8 and the gauze filter 10.

Furthermore, in this embodiment, a return passage 14 is connected to a passage between the downstream of the feed pump 5 and the upstream of the fuel filter 12 to return fuel to the upstream of the feed pump 5. The return passage 14 is provided with a return valve 15 serving as a return flow control unit for controlling flow of fuel returning to the upstream of the feed pump 5 through the return passage 14.

The return valve 15 includes a valve body for controlling opening in the fuel passage, a spring unit for biasing the valve body to close the fuel passage, and the like. The return valve 15 is a pressure control valve having a mechanical structure being capable of controlling pressure of fuel downstream of the feed pump at the predetermined pressure. The return valve 15 serves as a return flow control unit.

In this embodiment the return valve 15 opens at the predetermined pressure, which is slightly less than the predetermined pressure, at which the return valve 15 opens.

In this structure, the return valve 15 opens before the relief valve 13 opens, thereby retuning fuel from the downstream of the feed pump 5 to the upstream of the feed pump 5. Furthermore, the relief valve 13 opens, when pressure of fuel in the downstream of the feed pump 5 increases even in a condition where the return valve 15 opens.

The inlet control valve 7 is connected downstream of the fuel filter 12 through a fuel passage 12*a*. Furthermore, the fuel passage 12*a* is provided with an orifice 16. The inlet control valve 7 is an electromagnetic valve having a linear solenoid, which is capable of manipulating opening thereof based on a control signal transmitted from the ECU. The ECU transmits the control signal in accordance with an operating condition of the diesel engine.

The orifice 16 serves as a throttle unit capable of throttling the fuel passage 12*a*, which extends from the fuel filter 12 to the inlet control valve 7, thereby restricting flow of fuel through the fuel filter 12. A passage between the downstream of the orifice 16 and the upstream of the inlet control valve 7 in the fuel passage 12*a* is connected with a passage between the downstream of the gauze filter 10 and the upstream of the feed pump 5 through a fuel passage 12*b*. The fuel passage 12*b* is provided with a regulate valve 17.

The regulate valve 17 includes a mechanical structure similar to that of the return valve 15, and is capable of controlling pressure of fuel in the downstream of the orifice 16 at pressure equal to or less than constant pressure. The fuel passage 12*b* is connected with a fuel passage 12*c* through which fuel flows from the upstream of the regulate valve 17 to a cam chamber 64 of the high-pressure pump 6.

The high-pressure pump 6 is connected with the downstream of the inlet control valve 7 through a fuel passage 7*a*. The fuel passage 7*a* is further connected with a fuel passage 7*b* through which fuel returns to the upstream of the gauze filter 10 through an orifice 18. In this structure, when, for example, the inlet control valve 7 closes, surplus fuel is capable of returning from the downstream of the inlet control valve 7 to the upstream of the feed pump 5.

As shown by the area surrounded by the chain line in FIG. 1, the high-pressure pump 6 includes the camshaft 61 being rotatable as driven by the diesel engine, plungers 62 axially movable through the cylinder by being transmitted with driving force from the camshaft 61, and the like. In this embodiment, the high-pressure pump 6 includes two plungers 62 being opposed to each other with respect to the radial direction of the camshaft 61. The plungers 62 alternately move to draw and press-feed fuel.

The camshaft 61 is connected with a cam 63 capable of converting a rotative movement of the camshaft 61 to an axial movement and transmitting the axial movement to the plungers 62. The cam 63 is accommodated in the cam chamber 64 of a pump housing. In this structure, fuel flows into the cam chamber 64 through the fuel passage 12*c*, and the fuel serves as lubricating oil in transmission of driving force from the cam 63 to each plunger 62.

The fuel passage 12*c* is provided with an orifice 19. The orifice 19 regulates fuel as lubricating oil flowing into the cam chamber 64. Surplus fuel overflowing from the cam chamber 64 returns to the fuel tank 4 through a fuel passage 6*a*.

The cylinder therein defines a compression chamber 65, which variably changes in volume correspondingly to the axial movement of the plunger 62. The compression chamber 65 is connected with an inlet passage 65*a*, through which fuel passes from the fuel passage 7*a* to the compression chamber 65, and an outlet passage 65*b*, through which fuel passes from the compression chamber 65 to the common rail 1.

The inlet passage 65*a* is provided with an inlet valve 66, which opens when fuel flows into the compression chamber 65. The outlet passage 65*b* is provided with an outlet valve 67, which opens when fuel flows out of the compression chamber 65. The outlet passage 65*b* is connected with the common rail 1 through a fuel passage 1*c*.

Next, an operation of the fuel feed apparatus is described. First, the camshaft 61 of the high-pressure pump 6 rotates in conjunction with the operation of the diesel engine in the vehicle. The camshaft 61 is connected with the feed pump 5, so that the camshaft 61 transmits driving force to the feed pump 5.

The feed pump 5 is transmitted with the driving force, thereby pumping fuel from the fuel tank 4 through the inlet pipe 4*a*. In this operation, the fuel passes through the pre-filter 8 and the gauze filter 10 in order, thereby being filtered. The fuel press-fed from the feed pump 5 is further filtered through the fuel filter 12, and the fuel flows into the inlet control valve 7 after passing through the fuel passage 12*a*.

The ECU controls the opening of the inlet control valve 7 by transmitting the control signal, so that fuel flows into the high-pressure pump 6 through the fuel passage 7*a* by an amount sufficient for the operation of the diesel engine of the vehicle.

The cam 63 rotates together with the camshaft 61, thereby axially actuating the plunger 62 in the high-pressure pump 6. The plunger 62 moves toward the camshaft 61 in the cylinder by being axially actuated, so that the compression chamber 65 increases in volume and decreases in pressure. In this operation, the inlet valve 66 opens to draw fuel from the downstream of the inlet control valve 7 into the compression chamber 65 after passing through the fuel passage 7*a* and the inlet passage 65*a* in order.

Alternatively, the plunger 62 moves away from the camshaft 61 in the cylinder, so that the compression chamber 65 decreases in volume, thereby press-feeding fuel drawn into the compression chamber 65. When pressure of the compressed fuel becomes greater than the predetermined pressure, the outlet valve 67 opens, so that fuel is press-fed from the compression chamber 65 into the common rail 1 after passing through the outlet passage 65*b* and the fuel passage 1*c* in order.

Thus, the common rail 1 accumulates high-pressure fuel. The high-pressure fuel accumulated in the common rail 1 is injected into the combustion chamber of the diesel engine through the injector 2, which is manipulated in accordance with the control signal transmitted from the ECU.

In this embodiment the fuel filter 12 is provided downstream of the feed pump 5, so that the fuel filter 12 is applied with the discharge pressure of the feed pump 5. Therefore, the fuel filter 12 can be restricted from being plugged even when viscosity of fuel increases in, for example, a low temperature condition. As a result, the high-pressure pump 6 can be sufficiently supplied with fuel, so that the diesel engine can be restricted from causing a defect such as engine stall due to insufficient supply of fuel.

In addition, the orifice 16 is provided between the fuel filter 12 and the inlet control valve 7, thereby restricting fuel passing through the fuel filter 12. Consequently, the fuel filter can be restricted from being enlarged, even in a structure in which the fuel filter 12 is arranged downstream of the feed pump 5. Thus, an installation space for the fuel filter 12 can be reduced.

Furthermore, in this embodiment, the fuel feed apparatus includes the return passage 14 and the return valve 15. In this structure, when pressure of fuel in the passage between the downstream of the feed pump 5 and the upstream of the fuel filter 12 becomes equal to or greater than predetermined pressure, the return valve opens. Thus, fuel can be properly returned from the downstream of the feed pump 5 to the upstream of the feed pump 5. In this structure, pressure loss caused in drawing fuel into the feed pump 5 can be reduced. In addition, the inlet pipe 4*a* need not be enlarged in diameter so that the fuel feed apparatus can be restricted from being excessively enlarged.

Furthermore, the predetermined pressure, at which the return valve 15 opens, is slightly less than the predetermined pressure, at which the relief valve 13 opens. In this structure, fuel in the downstream of the feed pump 5 can be steadily returned to the upstream of the feed pump before the relief valve 13 opens.

Furthermore, the return passage 14 directly connects the upstream of the feed pump 5 with the downstream of the feed pump 5, and the return valve 15 is provided to the return passage 14. In this structure, the fuel feed apparatus can be further restricted from being enlarged.

Consequently, pressure loss caused in drawing fuel into the feed pump 5 can be reduced, so that lifetime of the feed pump 5 can be enhanced, while the fuel feed apparatus 3 is restricted from being enlarged.

Furthermore, in the above structure, the amount of fuel returning to the fuel tank 4 can be reduced by returning fuel to the upstream of the feed pump 5, so that production of fuel vapor in the fuel tank 4 can be reduced. Thus, fuel consumption can be reduced.

Second Embodiment

Figure 2:
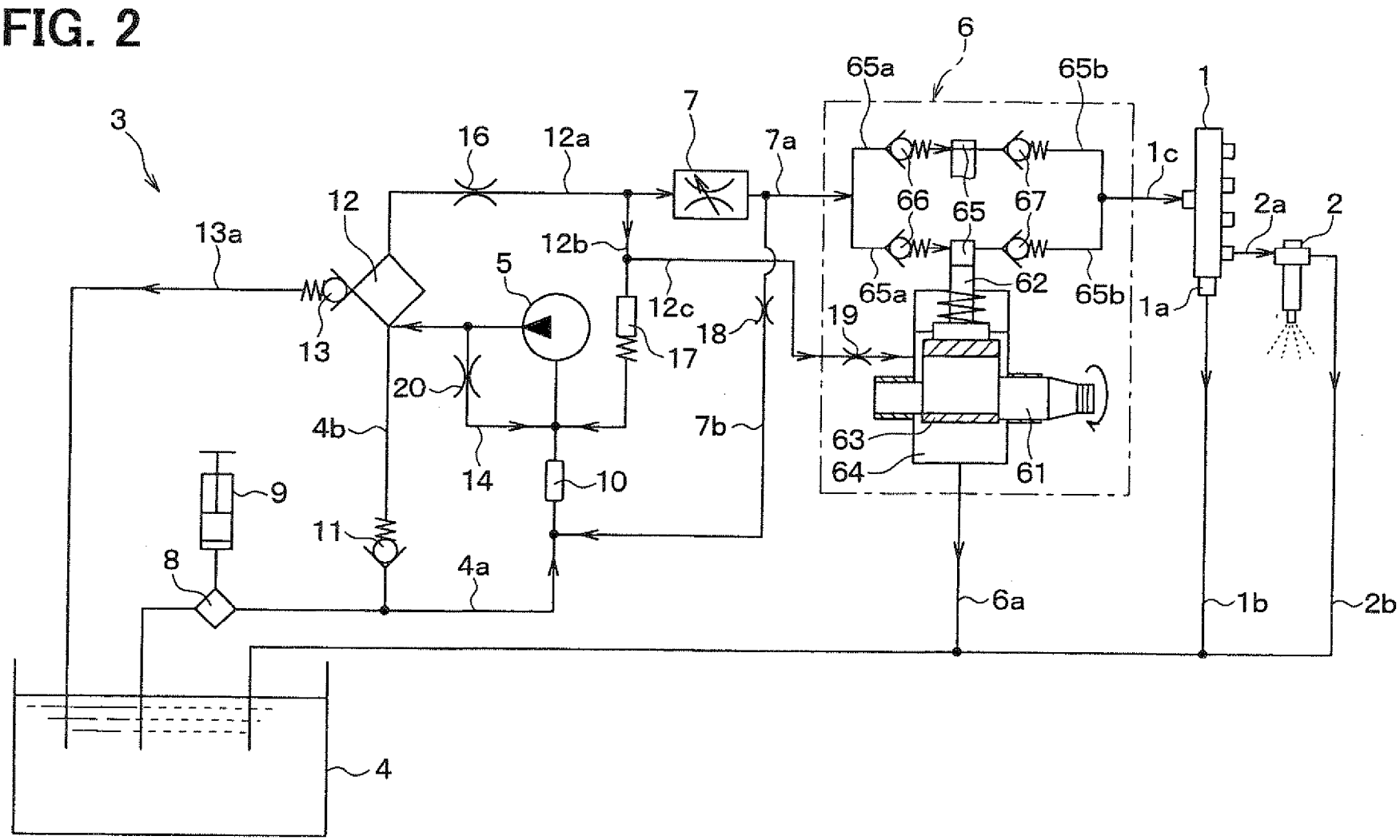
FIG. 2 is a schematic view showing an accumulator fuel injection system according to a second embodiment.

In this embodiment as shown in FIG. 2, an orifice 20 is provided to serve as a return flow control unit.

The orifice 20 is a fixed throttle for reducing pressure of fuel downstream of the feed pump 5. A capillary tube may be used as the fixed throttle to serve as the return flow control unit. In this embodiment, the orifice 20, i.e., return flow control unit is provided to the return passage 14, so that the amount of fuel returning through the return passage 14 can be increased correspondingly to increase in pressure difference between the upstream of the feed pump 5 and the downstream of the feed pump 5.

In this structure, as pressure of fuel downstream of the feed pump 5 increases to the predetermined pressure, at which the relief valve 13 opens, the amount of the fuel returning through the return passage 14 can be increased. The structure of the fuel feed apparatus other than the feature of this embodiment is substantially equivalent to that of the first embodiment.

In this embodiment, fuel in the downstream of the feed pump 5 can be properly returned to the upstream of the feed pump 5 under operation of the fuel feed apparatus 3, similarly to the first embodiment. Consequently, pressure loss caused in drawing fuel into the feed pump 5 can be reduced, so that lifetime of the feed pump 5 can be enhanced, while the fuel feed apparatus 3 is restricted from being enlarged.

Third Embodiment

Figure 3:
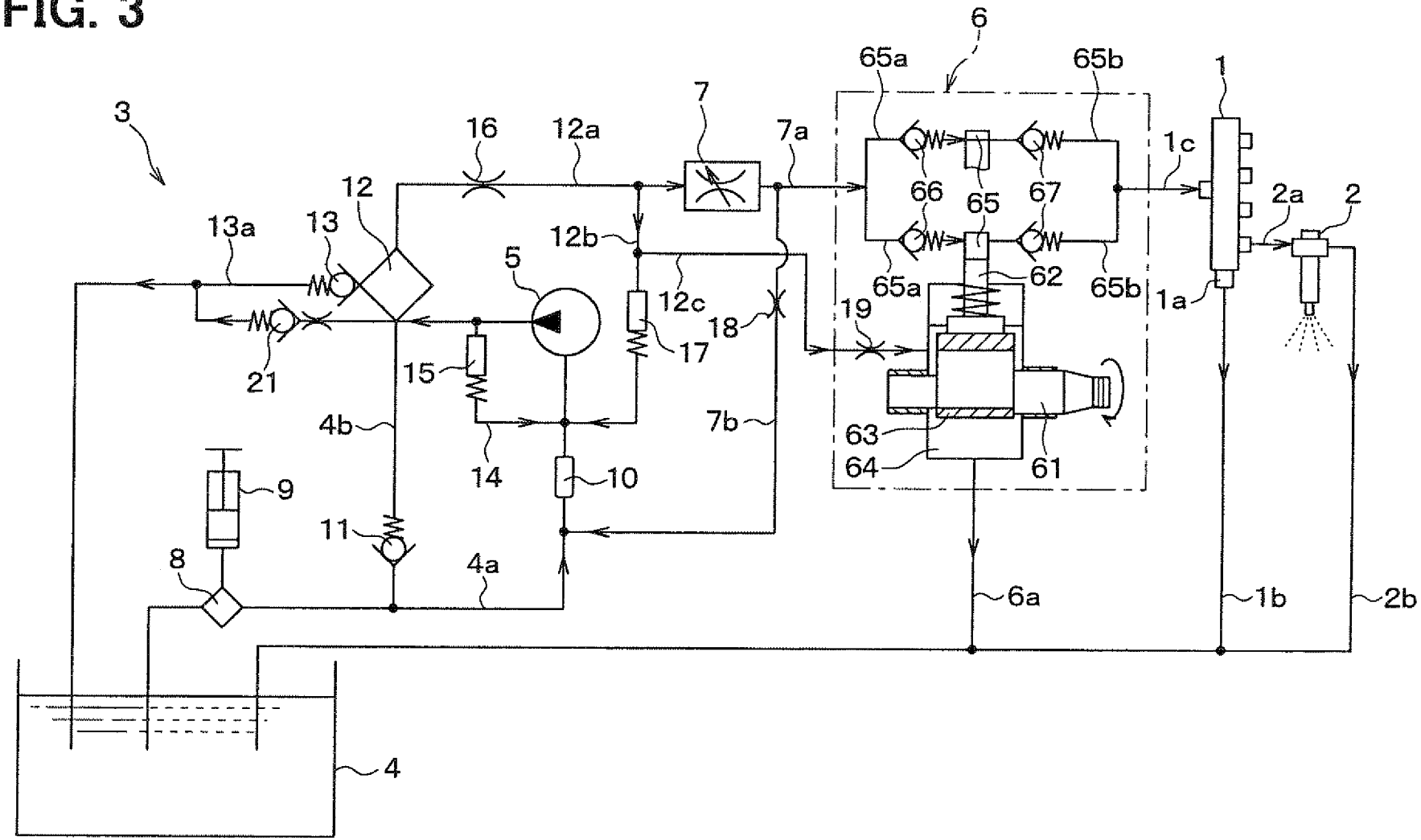
FIG. 3 is a schematic view showing an accumulator fuel injection system according to a third embodiment.

In this embodiment as shown in FIG. 3, a vent valve 21 is provided to the fuel feed apparatus in the first embodiment for venting gas accumulated in the fuel feed passage.

The vent valve 21 has a structure similar to that of the relief valve 13. The vent valve 21 is located at a location, where gas is apt to be accumulated, downstream of the feed pump 5. Specifically, the vent valve 21 is located at, for example, a vertically upper portion of a case, which accommodates the fuel filter 12.

Furthermore, the vent valve 21 opens at predetermined pressure equal to or less than the allowable pressure of the fuel filter 12, and is less than the predetermined pressure at which the relief valve 13 opens. When pressure of fuel downstream of the feed pump 5 increases, so that the vent valve opens, gas accumulating in the fuel passage returns to the fuel tank 4 together with fuel discharged from the feed pump 5 through the fuel pipe 13*a*.

In this embodiment, the fuel feed apparatus is capable of venting gas accumulating in the fuel passage by utilizing discharge pressure of the feed pump 5, in addition to producing effects similarly to that of the first embodiment.

Fourth Embodiment

Figure 4:
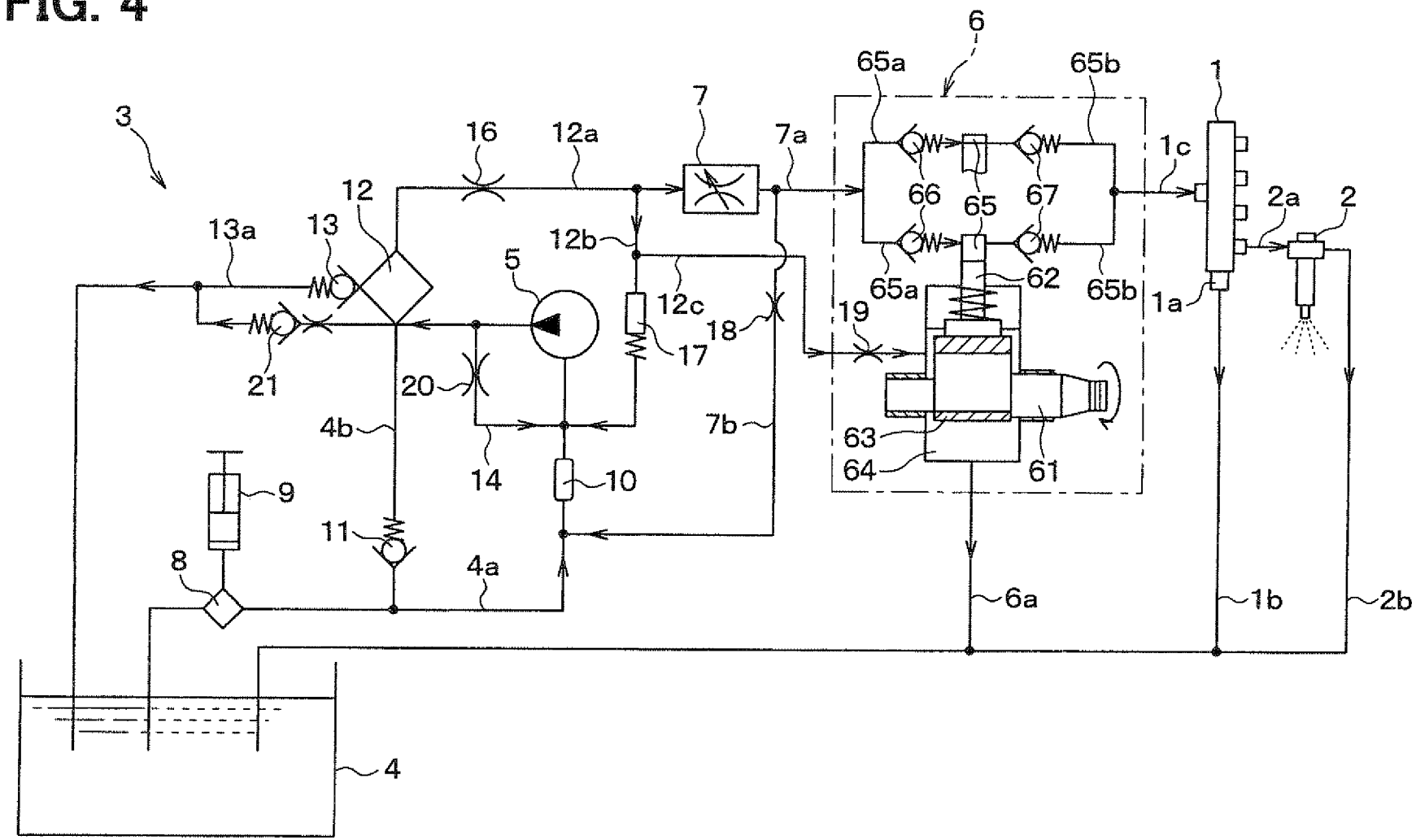
FIG. 4 is a schematic view showing an accumulator fuel injection system according to a fourth embodiment.

In this embodiment as shown in FIG. 4, the vent valve 21, which is equivalent to that of the third embodiment, is provided to the fuel feed apparatus of the second embodiment.

The fuel feed apparatus in this embodiment is capable of venting gas accumulating in the fuel passage by utilizing discharge pressure of the feed pump 5, in addition to producing effects similarly to that of the second embodiment.

Fifth Embodiment

Figure 5:
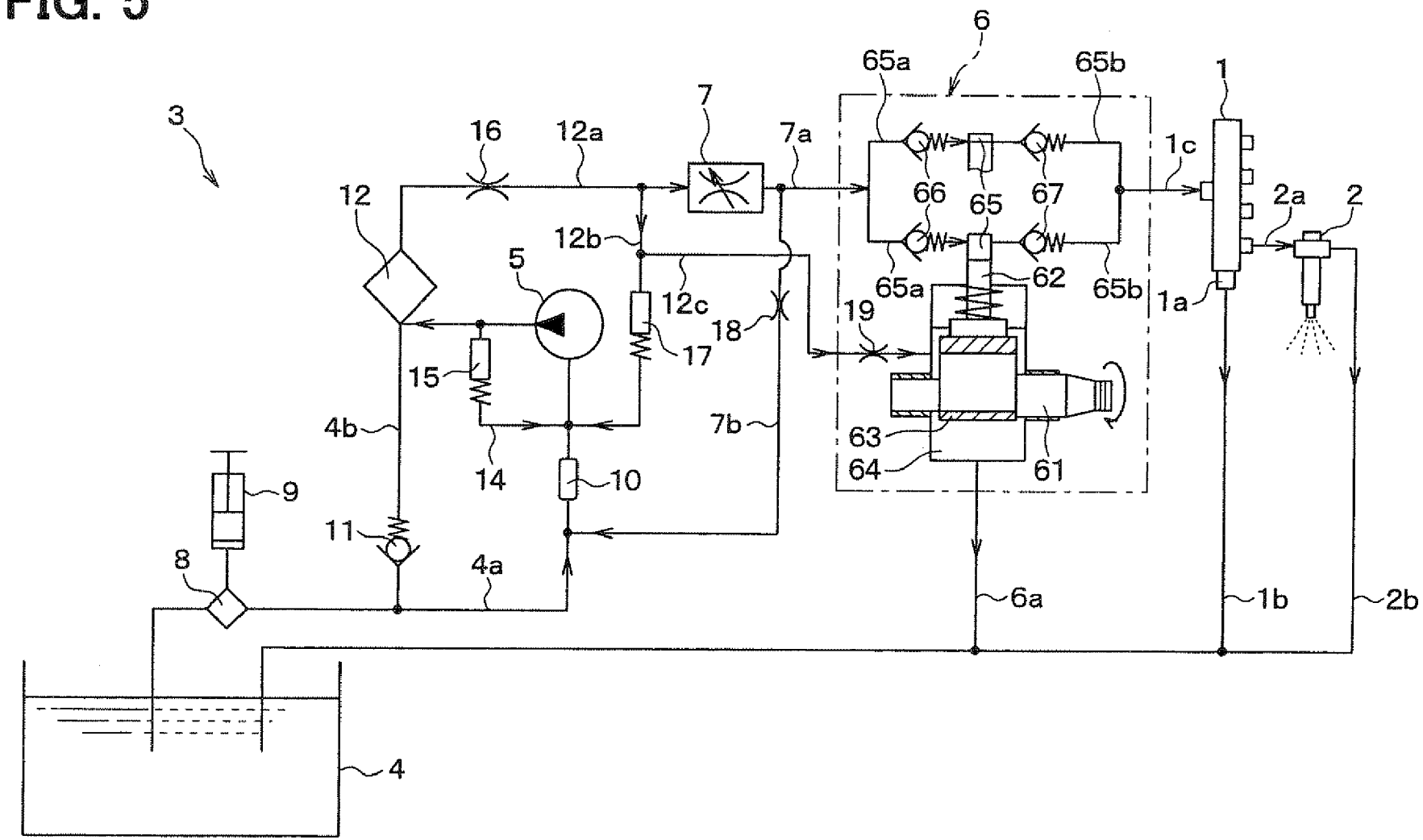
FIG. 5 is a schematic view showing an accumulator fuel injection system according to a fifth embodiment.

In this embodiment as shown in FIG. 5, the relief valve 13 and the fuel pipe 13*a* are omitted from the fuel feed apparatus of the first embodiment. The structure of the fuel feed apparatus other than the feature of this embodiment is substantially equivalent to that of the first embodiment. As described in the above embodiments, the predetermined pressure, at which the return valve 15 opens, is lower than the predetermined pressure, at which the relief valve 13 opens. Therefore, the return valve 15 opens before the relief valve 13 opens, so that fuel downstream of the feed pump 5 can be returned to the upstream of the feed pump 5.

In this structure, the relief valve 13 is capable of protecting the fuel filter 12 from excessive fuel pressure applied from the feed pump 5, by sufficiently securing the fuel passage in the return valve 15, even the relief valve 13 is omitted.

Consequently, lifetime of the feed pump 5 can be enhanced, while the fuel feed apparatus 3 is further restricted from being enlarged by omitting the relief valve 13 and the fuel pipe 13*a*. In addition, pressure loss caused in drawing fuel into the feed pump 5 can be reduced.

Sixth Embodiment

Figure 6:
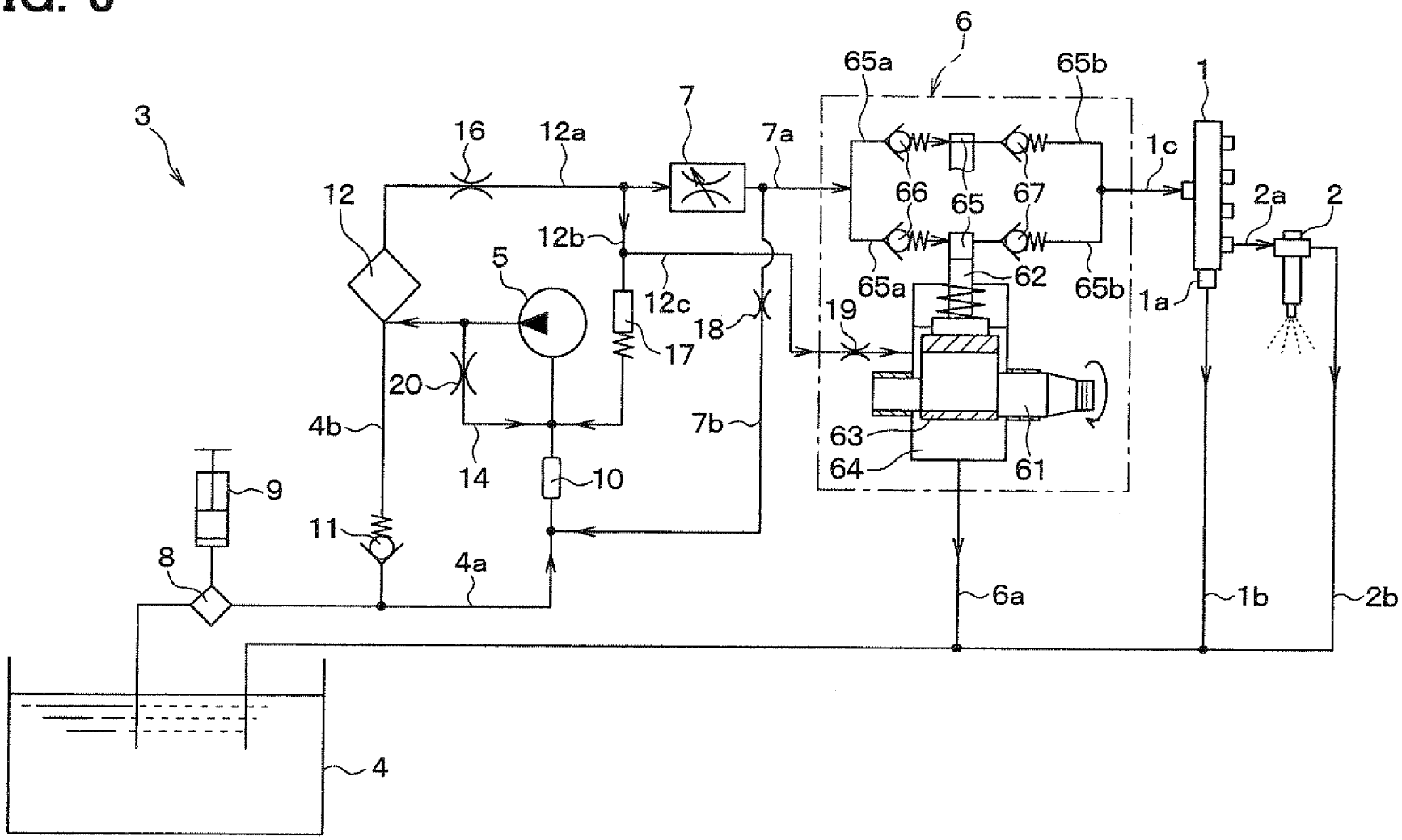
FIG. 6 is a schematic view showing an accumulator fuel injection system according to a sixth embodiment.

In this embodiment as shown in FIG. 6, the relief valve 13 and the fuel pipe 13*a* are omitted from the fuel feed apparatus of the second embodiment. The structure of the fuel feed apparatus other than the feature of this embodiment is substantially equivalent to that of the second embodiment.

In this embodiment, when the fuel feed apparatus 3 is operated, the relief valve 13 is capable of protecting the fuel filter 12 from excessive fuel pressure applied from the feed pump 5, by sufficiently returning fuel from the downstream of the feed pump 5 to the upstream of the feed pump 5, even the relief valve 13 is omitted. Thus, the fuel feed apparatus is capable of producing effects similarly to the fifth embodiment.

Seventh and Eighth Embodiments

Figure 7:
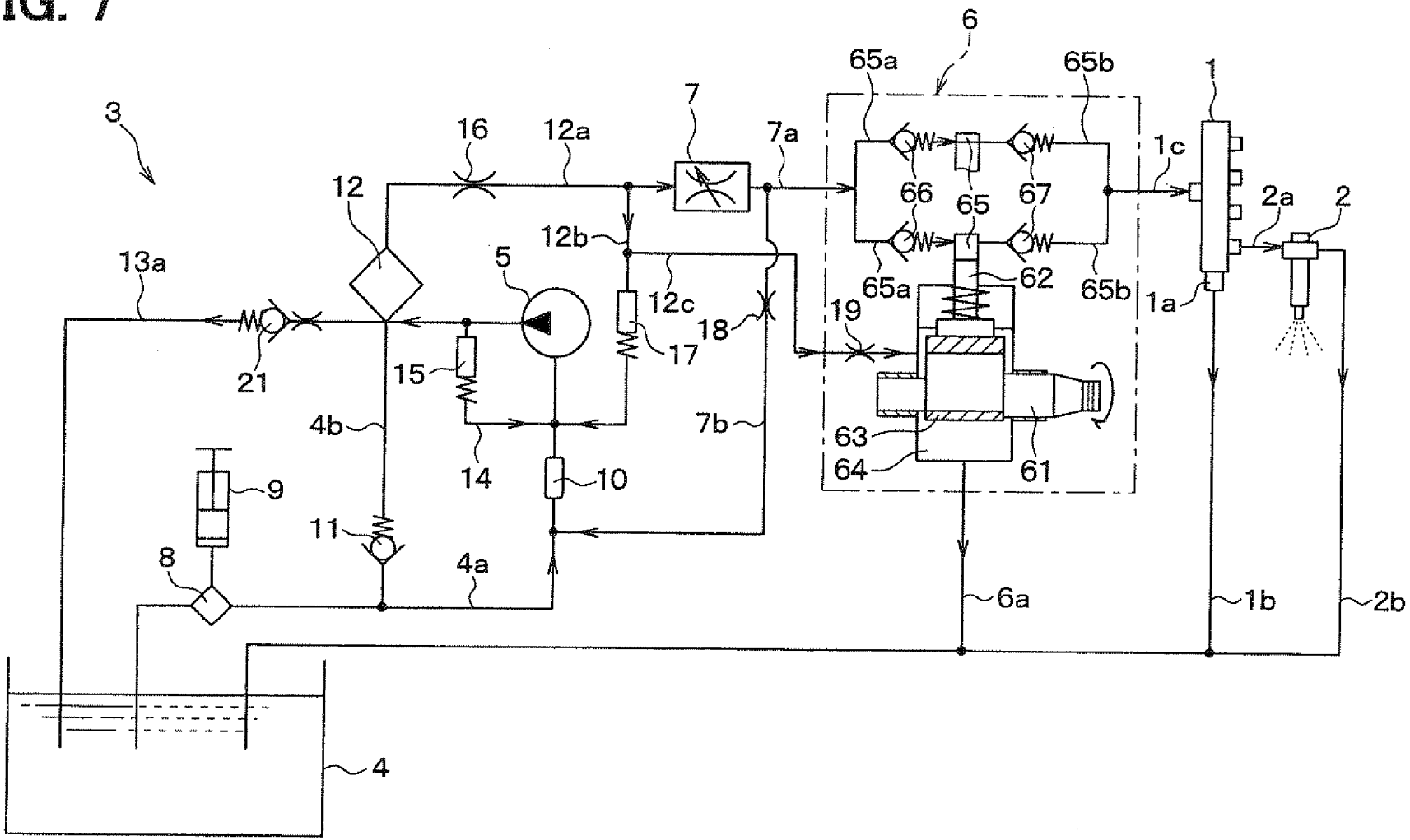
FIG. 7 is a schematic view showing an accumulator fuel injection system according to a seventh embodiment.
Figure 8:
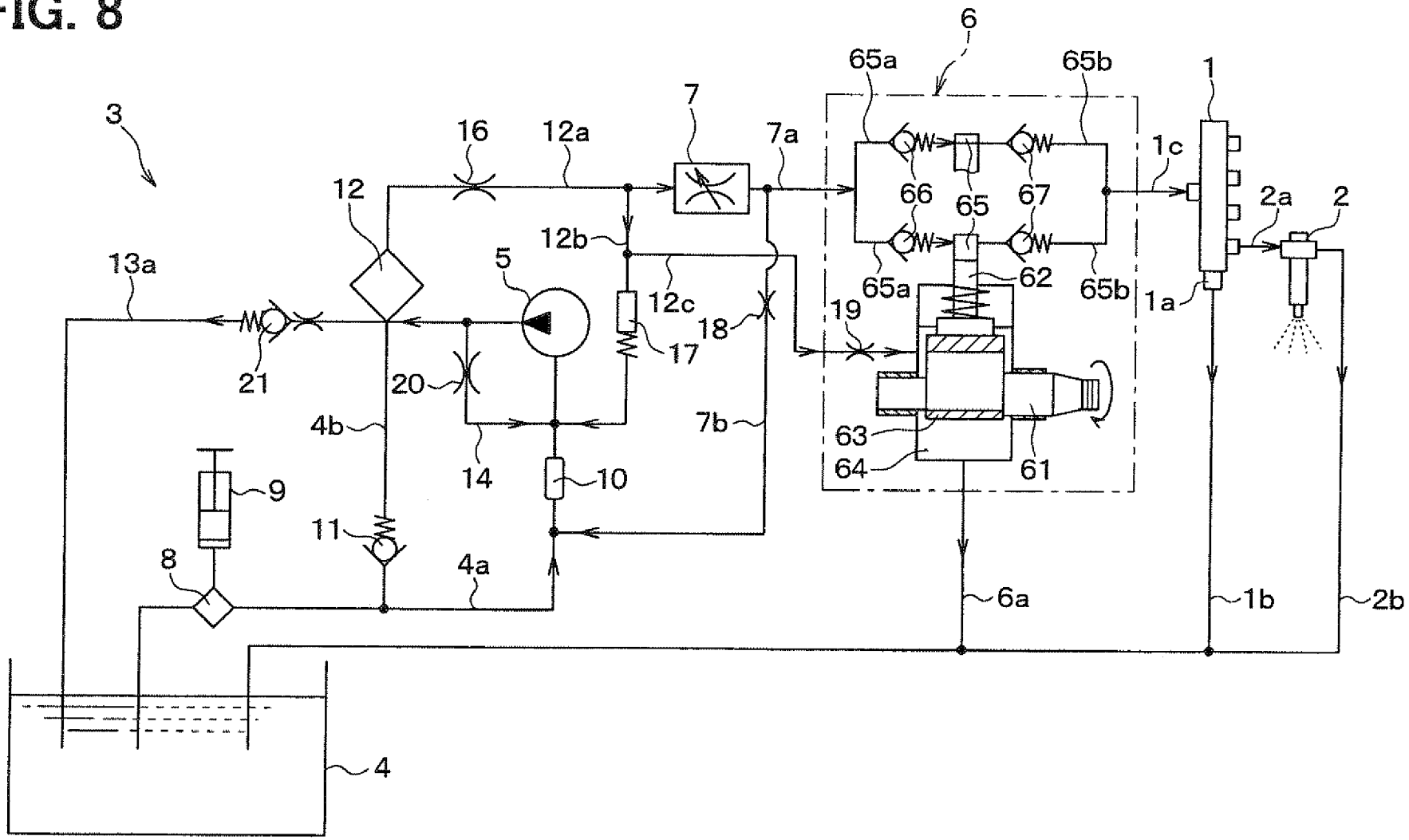
FIG. 8 is a schematic view showing an accumulator fuel injection system according to a eighth embodiment.

In the seventh embodiment, as shown in FIG. 7, the relief valve 13 is omitted from the fuel feed apparatus of the third embodiment. In the eighth embodiment, as shown in FIG. 8, the relief valve 13 is omitted from the fuel feed apparatus of the fourth embodiment. The structures of each fuel feed apparatus other than the feature of those embodiments are substantially equivalent to those of the third and fourth embodiments. Each fuel feed apparatus of those embodiments is also capable of producing effects similar to those of the fifth embodiment, and furthermore, is capable of venting gas accumulating in the fuel passage.

Other Embodiments

In the above embodiments, the feed pump 5 is a trochoid pump. However, the feed pump is not limited to a trochoid pump. For example, the feed pump 5 may be any other pump such as a rolling piston pump and vane pump.

In the above embodiments, driving force of the feed pump 5 is transmitted from the engine via the camshaft 61. Alternatively, driving force of the feed pump 5 may be transmitted from another driving source.

The feed pump 5 and the high-pressure pump 6 may be integrally accommodated in a common housing.

In the above embodiments, the high-pressure pump 6 is a single-type high-pressure pump having two plungers 62 opposed to each other radially via the camshaft 61. Alternatively the high-pressure pump 6 may be a tandem-type high-pressure pump having four plungers 62 arranged around the camshaft 61 with respect to the rotative direction thereof.

In the above embodiments, the return passage 14 is directly connected with the passage between the downstream (outlet) of the teed pump 5 and the upstream (inlet) of the feed pump 5. However, the connection of the feed pump 5 is not limited to the above structure. For example, fuel may be returned from the downstream of the fuel filter 12 to the upstream of the feed pump 5.

Both the return valve 15 and the fixed throttle 20 may be provided to the fuel feed apparatus. For example, the return valve 15 and the fixed throttle 20 may be connected in parallel to construct a return flow control unit.

A variable throttle, which has a variable passage area therein, may be provided to serve as a return flow control unit, instead of the fixed throttle 20.

A return flow control unit may be provided to a connection between the return passage 14 and the fuel pipe downstream of the feed pump 5. for example.

The relief valve 13 may also serve as the vent valve 21.

In each of the above embodiments, the fuel feed apparatus is applied to the accumulator fuel injection system including the inlet control valve 7 for controlling flow of fuel to be compressed using the high-pressure pump 6, i.e., an inlet control accumulator fuel injection system. Alternatively, the fuel feed apparatus may be applied to an accumulator fuel injection system capable of controlling flow of press-fed fuel to the common rail by controlling valve-close timing of an outlet valve of a variable flow high-pressure pump, i.e., a pre-stroke control accumulator fuel injection system.

The above structures of the embodiments can be combined as appropriate.

Various modifications and alternations may be diversely made to the above embodiments without departing from the spirit of the present invention.

What is claimed is:

1. A fuel feed apparatus for supplying high-pressure fuel to a common rail of an accumulator fuel injection system, the accumulator fuel injection system including an injector for injecting high-pressure fuel accumulated in the common rail into a combustion chamber of an internal combustion engine, the fuel feed apparatus comprising:

a high-pressure pump for pressurizing fuel and press-feeding the fuel to the common rail;

a feed pump for pumping fuel from a fuel tank to the high-pressure pump;

a fuel filter provided downstream of the feed pump for filtering fuel pumped from the feed pump;

a return passage for returning fuel from a downstream of the feed pump to an upstream of the feed pump;

a return flow control unit for controlling flow of fuel returning through the return passage; and a vent valve provided downstream of the feed pump and upstream of the fuel filter for venting gas from the downstream of the feed pump, wherein the return passage is adapted to return fuel from a passage between a downstream of the feed pump and an upstream of the fuel filter.

2. The fuel feed apparatus according to claim 1, further comprising:

a relief valve for releasing fuel applying pressure to the fuel filter when the pressure becomes equal to or greater than predetermined pressure.

3. The fuel feed apparatus according to claim 1, wherein the return flow control unit is located at the return passage.

4. The fuel feed apparatus according to claim 1, wherein the return flow control unit includes a pressure control valve adapted to control pressure of fuel downstream of the feed pump at predetermined pressure by manipulating an opening of the return passage.

5. The fuel feed apparatus according to claim 1, wherein the return flow control unit includes a throttle adapted to reducing pressure downstream of the feed pump.

6. An accumulator fuel injection system for injecting high-pressure fuel into a combustion chamber of an internal combustion engine, the accumulator fuel injection system comprising:

a common rail for accumulating high-pressure fuel;

an injector for injecting high-pressure from the common rail into the combustion chamber; and a fuel feed apparatus for supplying high-pressure fuel to the common rail;

wherein the fuel feed apparatus comprising:

a high-pressure pump for pressurizing fuel and press-feeding the fuel to the common rail;

a feed pump for pumping fuel from a fuel tank to the high-pressure pump;

a fuel filter provided downstream the feed pump for filtering fuel pumped from the feed pump;

a return passage for returning fuel from a downstream of the feed pump to an upstream of the feed pump;

a return flow control unit for controlling flow of fuel returning through the return passage; and a vent valve provided downstream of the feed pump and upstream of the fuel filter for venting gas from the downstream of the feed pump, wherein the return passage is adapted to return fuel from a passage between a downstream of the feed pump and an upstream of the fuel filter.

7. The accumulator fuel injection system according to claim 6, wherein the fuel feed apparatus further comprising:

a relief valve for releasing fuel applying pressure to the fuel filter when the pressure becomes equal to or greater than predetermined pressure.

8. The fuel feed apparatus according to claim 1, wherein the return passage directly connects the passage between the downstream of the feed pump and the upstream of the fuel filter with the upstream of the feed pump.

9. The fuel feed apparatus according to claim 4, wherein the pressure control valve is provided in the return passage.

10. The fuel feed apparatus according to claim 6, wherein the return passage directly connects the passage between the downstream of the feed pump and the upstream of the fuel filter with the upstream of the feed pump.

11. The fuel feed apparatus according to claim 6, wherein the return flow control unit includes a pressure control valve, which is provided in the return passage and adapted to control pressure of fuel downstream of the feed pump at predetermined pressure by manipulating an opening of the return passage.

* * * * *